US008845122B2

(12) United States Patent
Redpath et al.

(10) Patent No.: US 8,845,122 B2
(45) Date of Patent: Sep. 30, 2014

(54) METHOD FOR A SAFE ALTERNATIVE TO PYROTECHNIC PROJECTION OF LIGHT FROM WARDROBE

(76) Inventors: Richard Redpath, Cary, NC (US); James Redpath, Cary, NC (US)

( * ) Notice: Subject to any disclaimer, the term of this patent is extended or adjusted under 35 U.S.C. 154(b) by 254 days.

(21) Appl. No.: 13/517,628

(22) Filed: Jun. 14, 2012

(65) Prior Publication Data

US 2013/0335950 A1 Dec. 19, 2013

(51) Int. Cl.
*F21L 4/00* (2006.01)

(52) U.S. Cl.
CPC ..... *F21L 11/00* (2013.01); *A41D 2600/00* (2013.01); *A61D 1/002* (2013.01)
USPC ..... 362/108; 362/103; 362/259

(58) Field of Classification Search
USPC ..... 362/259, 253, 234, 103, 108
See application file for complete search history.

(56) References Cited

U.S. PATENT DOCUMENTS

| | | | | |
|---|---|---|---|---|
| 5,255,167 | A * | 10/1993 | Toussaint et al. | 362/103 |
| 6,144,302 | A * | 11/2000 | Cotty, Jr. et al. | 340/573.1 |
| 7,614,765 | B2 * | 11/2009 | Reason | 362/259 |
| 2007/0236916 | A1 * | 10/2007 | Hsu | 362/103 |
| 2008/0198578 | A1 * | 8/2008 | Finn | 362/103 |

* cited by examiner

*Primary Examiner* — Laura Tso
(74) *Attorney, Agent, or Firm* — Ming Chow; Sinorica, LLC

(57) ABSTRACT

This invention relates to a person's wardrobe for use in entertainment, and, in particular, on stage venues for projection of laser light from a person's body that is par to the pyrotechnic prior art for the large space of stage entertainment. The above system provides a unique small visual entertainment system that operates on batteries to enable the individual to walk about a large stage area which can entertain an audience.

2 Claims, 6 Drawing Sheets

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

160

$$\frac{m \lambda D}{d} \approx y \text{ (units cm)}$$

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

A METHOD FOR A SAFE ALTERNATIVE TO PYROTECHNIC PROJECTIONS OF LIGHT FROM WARDROBE

METHOD FOR A SAFE ALTERNATIVE TO PYROTECHNIC PROJECTION OF LIGHT FROM WARDROBE

RELATED APPLICATION INFORMATION

This application is related to, and claims priority from, U.S. Nonprovisional patent application Ser. No. 12/878,970 filed on Sep. 9, 2010, entitled "Laser Projection Bra System" the disclosure of which is incorporated here by reference.

BACKGROUND OF INVENTION

This invention relates to wardrobe for use in entertainment, and, in particular, on stage concerts for projection of laser light from a human form. The present invention provides a means to use a safe projection method of laser beams from a human body that is par to the pyrotechnic prior art for the large space of stage entertainment.

There are a number of filed patent illumination based products, systems or devices intended to accentuate the human form. For example, U.S. Pat. No. 7,878,675 is an LED neckline system designed to illuminate the cleavage and/or breasts. Another system is the provider www.lightgod.com for illuminated apparel for "light up" bras and corsets and use electro-luminescent (EL) wire in various patterns. Although there are numerous illumination wardrobe mechanical designs for enhancing the human form, none can replace the dangerous pyrotechnical utility used for on stage projection of light for entertainment that has a distance range of 80 meters required for on stage entertainment, are safe for wearing and safe for the audience. Prior art pyrotechnic utility for ignition itself is inherently risky.

Another example, U.S. Pat. No. 7,614,765 of body carried laser lighting is for emergency response. This patent provides the fireman with a detachable brick device as a breadcrumb to leave behind to mark navigation back for escape to safety. This device uses one to two lasers to mark lines for front and/or back direction for escape navigation for areas walked [see U.S. Pat. No. 7,614,765 FIG. 2A thru FIG. 2C]. A Mylar type cap material is used to clearly cover the laser from heat penetration [column 4, lines 6-12] from the environment and enable beam output. As shown in U.S. Pat. No. 7,614,765 FIG. 3, the fireman carries a small set of brick units each being powered by its own containment system to provide a forward and/or backward beam of light. The intent of U.S. Pat. No. 7,614,765 is to use one to two lasers covered by Mylar caps to prevent heat damage and allow laser pass thru from the frequency tuned substrate for not modified coherent light to penetrate smoke and create a single beam line toward the direction previously walked. The unit is simply carried by the body for marking utility and dropped to mark areas for return from rescue. The patent is very much like the U.S. Design patent D402,218 and D510,039 with a Mylar cap to protect from heat for a new use of a laser line for rescue. The laser level has been around for over 25 years see U.S. Pat. No. 4,854,704. The U.S. Pat. No. 7,614,765 could not be a substitute for pyrotechnical projection of hundreds of light beams without the teachings of this embodiment to provide calculated uniform safe projection, reasonable power necessity to address thermal needs for cooling to produce over a hundred beams using a taught optics technique that can project 80 meters using one laser. Additionally the context of the problem solved by Reason has no value or insight to this embodiment of large projection for view by an audience as it would simply result in blinding light in a smoke filled area used to mark a path on the floor.

A woman's bra on stage has been used for entertainment purposes such as larger than normal support for breasts using cones. Furthermore, and more recently, pyrotechnics of projections of sparks and flames for entertainment have been used from a woman's body. In each reiteration an entertainer has tried to improve from one to the other. While prior art exists for different means for use of an implementation of a bra for on stage entertainment the current prior art of pyrotechnics is very dangerous especially to the individual and to the audience.

In this respect, a method for a safe alternative to pyrotechnical projection of light from wardrobe substantially departs from the conventional design of the modern day prior art and in doing so provides a safe new entertainment system with a unique greater potential for distance projection that is similar to pyrotechnical projection. Additionally, prior art of filed patent or available illumination based products, systems or devices intended to accentuate the human form could not be envisioned to provide 80 meter distance projection without addressing limiting power usage to create hundreds of beams that is practical to avoid thermal runaway as well as safe for humans that is similar to the visual of pyrotechnics. The inherent danger of open laser beams would preclude envisioning such a replacement.

BRIEF SUMMARY OF INVENTION

The invention relates to wardrobe for projection of laser light for use in on stage entertainment, and, in particular, on stage concerts. In view of the prior art, the present invention provides a safe and unique entertainment system with greater impact to the audience viewing. The embodiment of the invention provides a practical battery operated containment to allow the user freedom on stage with limited use of lasers for limited power consumption and not to require a thermal management system as well as a multiple beam creation solution that is safe for the audience and user.

DETAIL DESCRIPTION OF THE INVENTION

Figure 1:
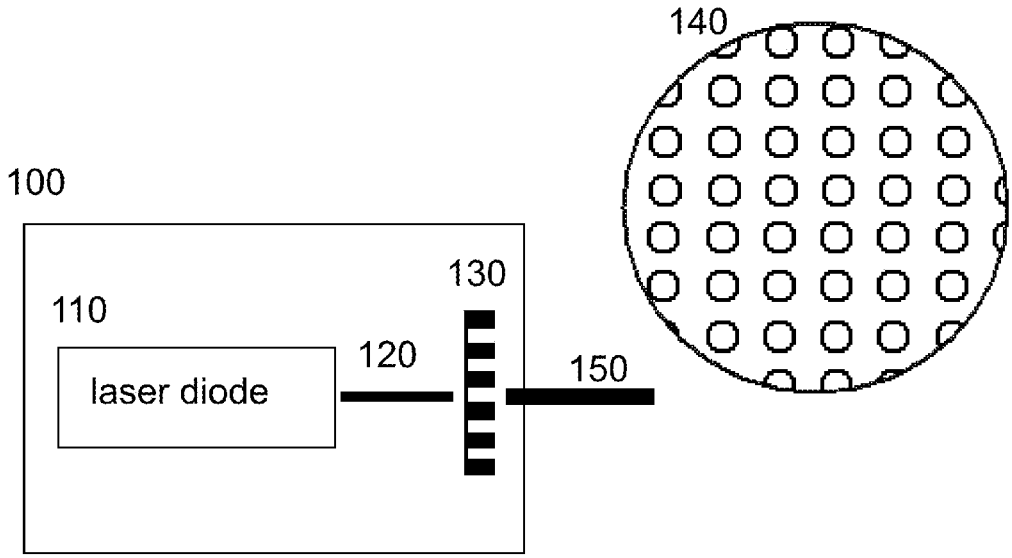
FIG. 1 is a diagram of the laser diffraction construction for the embodiment operation.

Referring to FIG. 1 at 100 is the operational embodiment which is constructed of a laser diode at 110 producing a beam at 120 to be incident with diffraction grating at 130. At 140 is a cross section of the output beam at 150 from the diffraction grating at 130.

An optimal diffraction grating at 130 for the embodiment to produce the effect of multiple laser beams can be calculated with the formula at 160. The displacement y is equal to the order m times the wavelength Lambda times the distance D divided by the slit separation d. The displacement from the center line for orders of m can be computed for optimal beam displacement. One skilled in the area of diffraction grating products can accurately compute the best diffraction grating but for completeness a 50 lines/mm diffraction grating is recommended. A 50 lines per millimeter diffraction grating has a slit separation of 20 micrometers 2.0 E-5 meters. Lambda is a green laser at 542 nm, D is a projection of 300 cm for an application such as a stage. Referring to FIG. 1 at 160 the formula result for a 50 lines/mm diffraction grating for first order m=1 computes a distance separation of approximately 8.13 cm. If the laser is red at 650 nm the displacement is 9.75 cm. For completeness the laser diode module at 110 should have a power output for safety of 20 mw to 28 mw at a wavelength of 532 nm or 450 nm with a divergence less than 1 mrad and beam diameter 1 mm. At this specification the laser output would be limited to less than 5 mw at a 70 mm distance for a class 3R laser for human safety. A visible inspection of using a 60 mm diffraction grating with a battery operated 20 mw 450 nm blue laser produced 225 laser beams that are visible for entertainment.

Figure 2A:
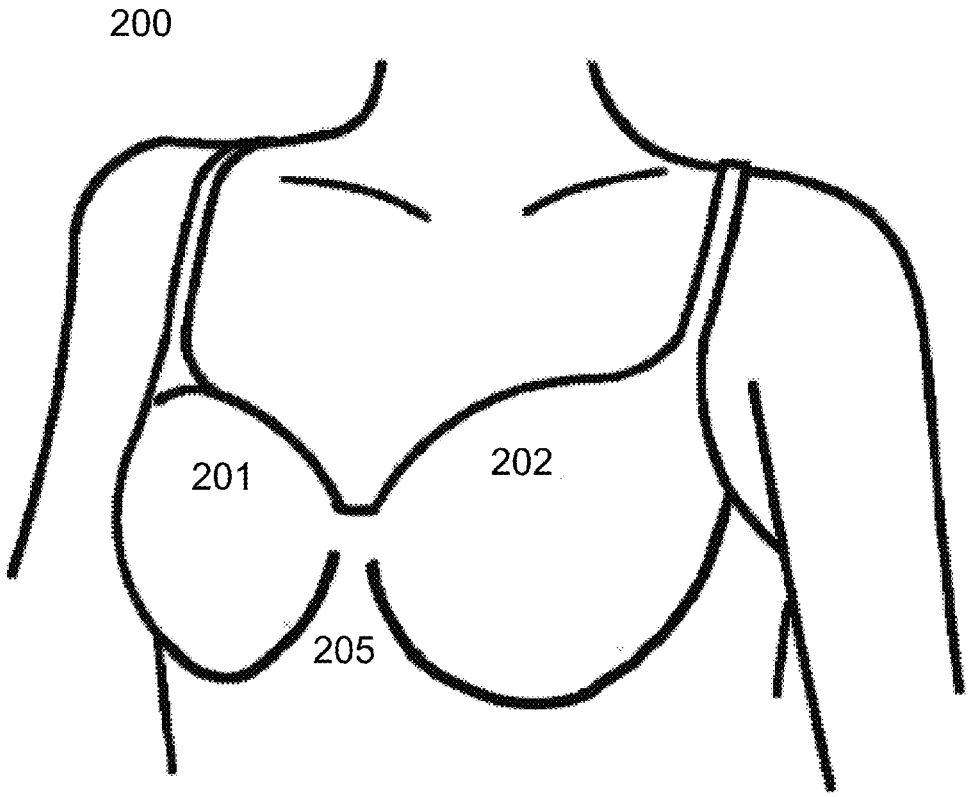
FIG. 2*a* is a diagram of the placement areas for the embodiment on the human body.

Referring to FIG. 2A at 200 is an outline of a female body for wardrobe design. At 205 is an outline of the wardrobe breast area. At 201 a laser module with diffraction grating in FIG. 1 at 100 is placed. Referring to FIG. 1 at 150 the laser exit port is pointing out from breast in FIG. 2A at 201. Referring to FIG. 2A at 202 another laser module with diffraction grating in FIG. 1 at 100 is placed. Referring to FIG. 1 at 150 the laser exit port is pointing out from breast shown in FIG. 2A at 202. Anyone skilled in wardrobe harness design can provide a means to anchor the laser modules referring to FIG. 2A at 201 and 202.

Figure 2B:
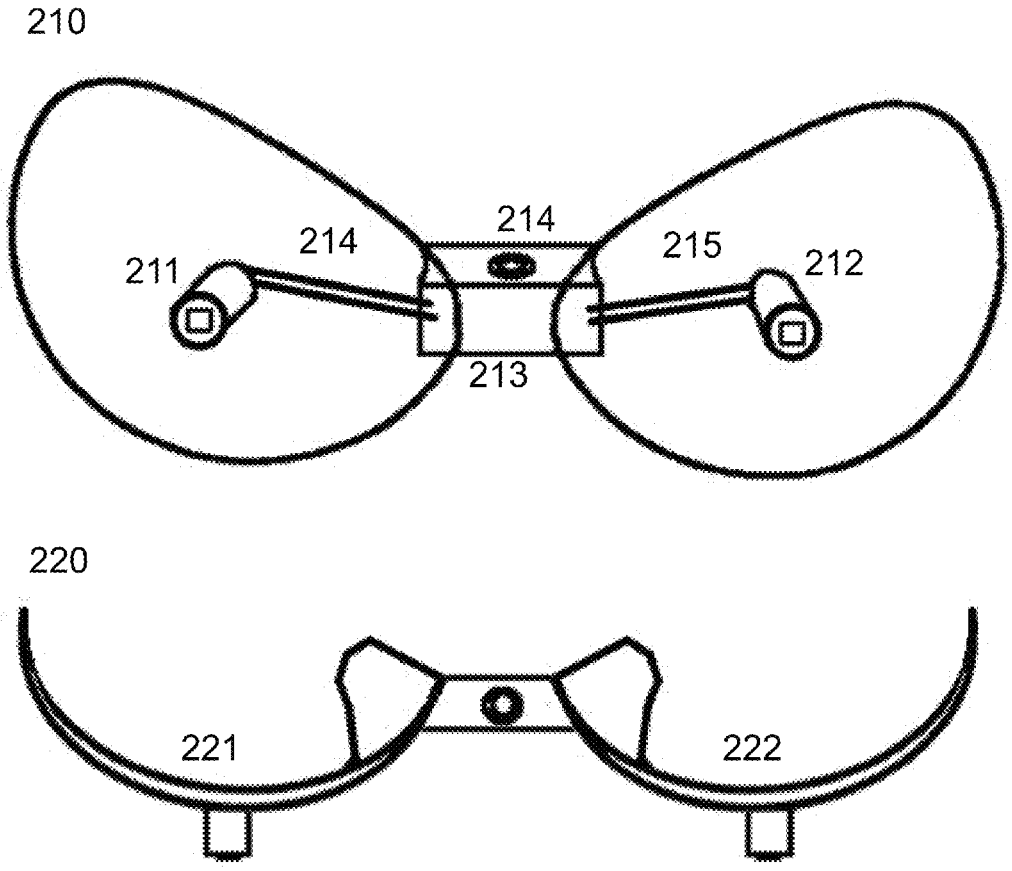
FIG. 2*b* is a diagram of an apparatus that can be used to mount the embodiment on the breast using a pair of lasers.

For completeness referring to FIG. 2B is a means to mount the laser diodes as a pair. At 210 is a front view of a lightweight metal plate shaped to fit a breast area. At 211 and 212 are mounting brackets for a laser diode with diffraction grating shown in FIG. 1 at 100. At 213 is a power unit with push button at 214. At 211 the laser diode is wired at 214 to power unit at 213. At 212 the laser diode is wired at 215 to power unit at 213. At 220 is a partial cross section of a lightweight metal plate shaped to fit the breast area. At 221 and 222 are hooks attached to the backing for a hook-and-loop fastener to enable the lightweight metal plate at 210 to adhere to a bra to mount.

Figure 2C:
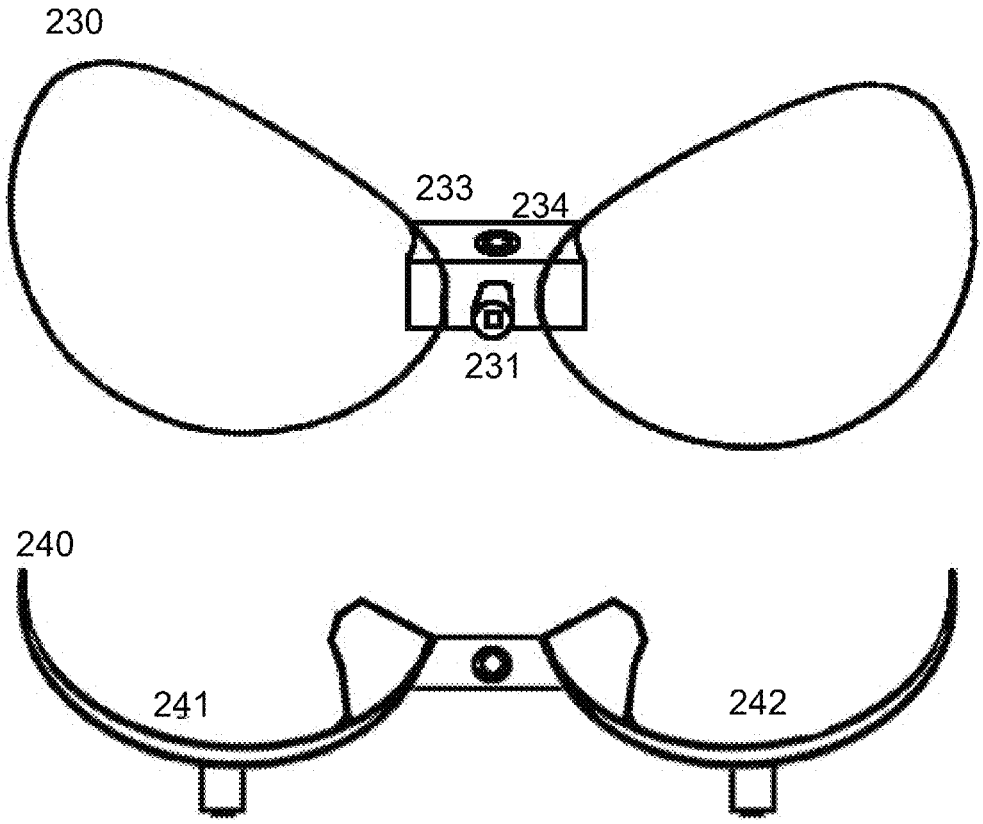
FIG. 2*c* is a diagram of an apparatus that can be used to mount the embodiment on the breast using one laser.

Referring to FIG. 2C is another means to mount a single laser diode shown at 230. At 230 is a front view of a lightweight metal plate shaped to fit a breast area. At 233 is a power unit with push button at 234 and laser diode mounting at 231 with diffraction grating shown in FIG. 1 at 100. Referring to FIG. 2C at 240 is a partial cross section of a lightweight metal plate shaped to fit a breast area. At 241 and 242 are hooks attached to the backing for a hook-and-loop fastener to enable the lightweight metal plate at 230 to adhere to a bra to mount.

Figure 2D:
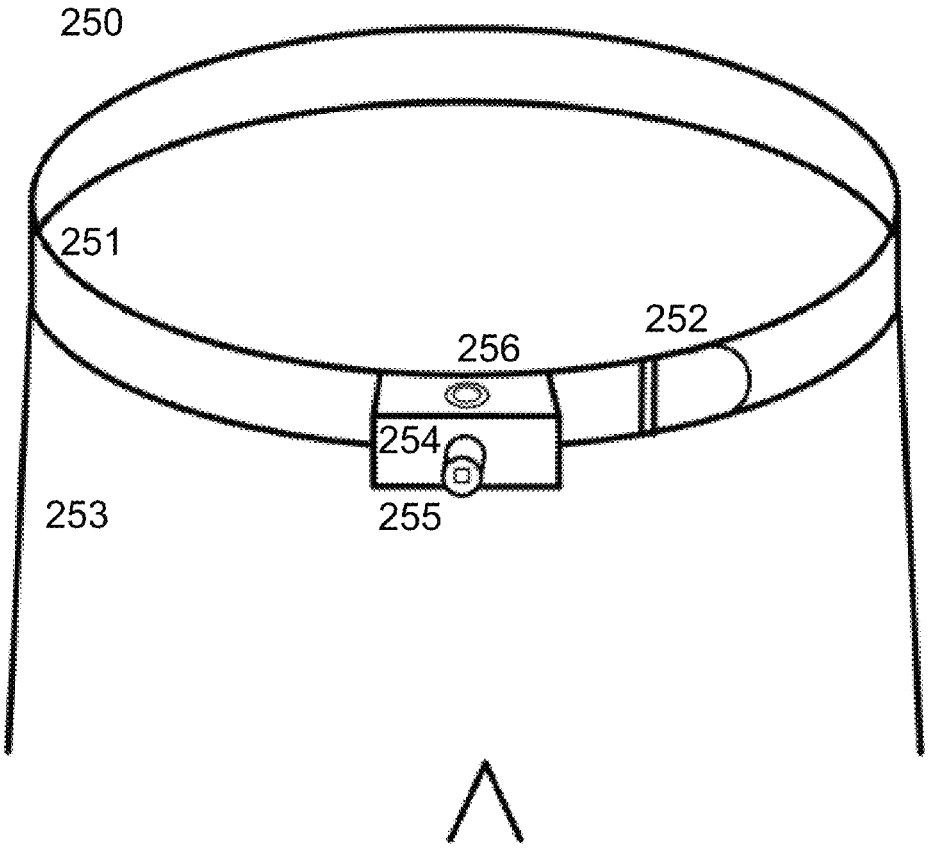
FIG. 2*d* is a diagram of an apparatus that can be used to mount the embodiment on the torso.

Referring to FIG. 2D is another means to mount a laser diode shown at 250. At 251 is a belt with buckle at 252 mounted on a torso at 253. At 254 is a power unit with push button at 256 and laser diode mount at 255 with diffraction grating in FIG. 1 at 100.

Figure 3:
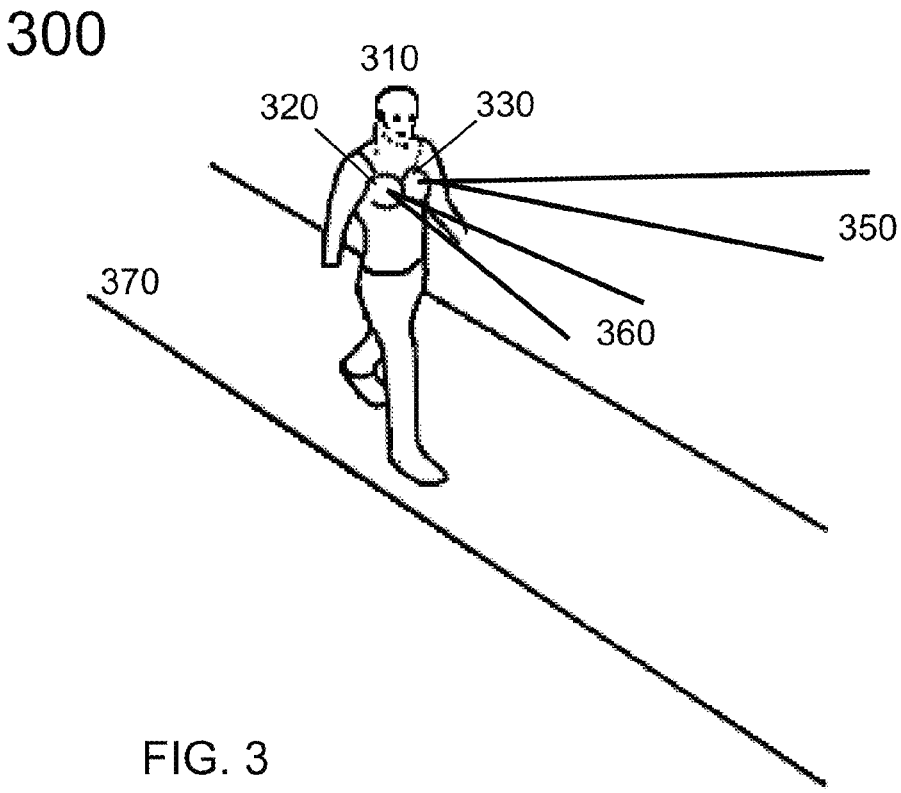
FIG. 3 is a diagram of the resulting projection from the embodiment on stage.

Referring to FIG. 3 at 300 is an entertainment stage diagram. At 370 is the stage area. At 310 is an entertainer wearing the embodiment at 320 and 330. At 350 and 360 is diagrammed the laser diffraction referring to FIG. 1 at 150 that is projected from the laser in FIG. 1 at 110 of the embodiment.

What is claimed is:

1. A method for a safe alternative to pyrotechnical projection of light from wardrobe comprising one or more visible light laser diode modules using a diffraction grating for multiple laser beams, mounted on the breast with power unit, wherein said laser diode modules being oriented so as to direct the multiple laser beams pointing out from body area for entertainment purposes; and using a breast plate to structurally hold the one or more visible light laser diode modules and the power unit, wherein said breast plate incorporating a hook-and-fastener as to adhere to a bra.

2. The method for a safe alternative to pyrotechnical projection of light from wardrobe of claim 1 mounting on a torso using a belt to structurally hold one or more laser diode modules using a diffraction grating for multiple beams and power unit.

* * * * *